United States Patent [19]

Tong

[11] Patent Number: 4,592,613

[45] Date of Patent: Jun. 3, 1986

[54] REPLACEABLE FUSE ADD-ON PLUG

[75] Inventor: George K. K. Tong, Hong Kong, Hong Kong

[73] Assignees: Chane Hwa Manufacturing Co. Ltd., Hong Kong; Tung Ming Electrical Co. Ltd., Taipei, Taiwan; Chane Hwa Electrical Co. Ltd., Tapiei, Taiwan

[21] Appl. No.: 664,578

[22] Filed: Oct. 25, 1984

[51] Int. Cl.[4] ..... H01H 85/02

[52] U.S. Cl. ..... 339/147 P; 337/197; 337/213

[58] Field of Search ..... 337/197, 198, 201, 213, 337/214, 215; 339/147 P, 166 R, 196 R, 196 M, 147 R

[56] References Cited

U.S. PATENT DOCUMENTS

| | | | |
|---|---|---|---|
| 2,644,056 | 6/1953 | Curtis | 337/198 |
| 2,988,617 | 6/1961 | Graziosi | 339/147 P |
| 3,829,819 | 8/1974 | Eckart | 339/147 P |
| 3,976,967 | 8/1976 | Magherini | 339/147 P |
| 4,178,061 | 12/1979 | Ahroni | 339/147 P |
| 4,351,580 | 9/1982 | Kirkman et al. | 339/75 MP |
| 4,352,540 | 10/1982 | Liu | 339/196 R |
| 4,420,214 | 12/1983 | Wu | 339/147 P |
| 4,480,891 | 11/1984 | Wu | 339/147 P |

*Primary Examiner*—Gil Weidenfeld
*Assistant Examiner*—Gary F. Paumen
*Attorney, Agent, or Firm*—Kalish & Gilster

[57] ABSTRACT

A fused plug (12) of the add-on type includes a body shell (13') formed of integral one-piece molded construction. The shell has a recess (23) opening forwardly. A fuse site body (27) is receivable within the recess. The fuse site body includes longitudinal recesses (39, 39') at opposite sides for receiving blade plugs (20, 20') in mutually secured relationship. Fuse-receiving recesses (32, 32') are defined in the forward end of the fuse site body for receiving a pair of miniature cartridge fuses (33, 33') with one end of each of the fuses electrically contacting a respective blade plug. The fuse site body also provides for electrical connection of wire leads (36, 36') with opposite ends of the fuses, such leads extending through an opening in the shell. The fuse site body is provided with projections (29) which fit into apertures (30) on opposite walls of the body shell for locking the fuse site body within the body shell in mutually secured relationship. A fuse cover (22), which includes a spring on its inner surface, covers the recess opening for pressing the fuses into their recesses, and prevents the user from having access to the fuses without first unplugging the plug blades from an electrical receptacle.

10 Claims, 7 Drawing Figures

FIG. 1(a) PRIOR ART
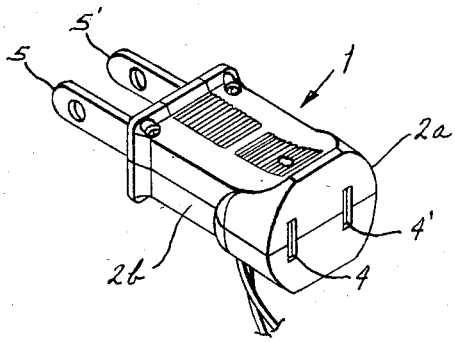
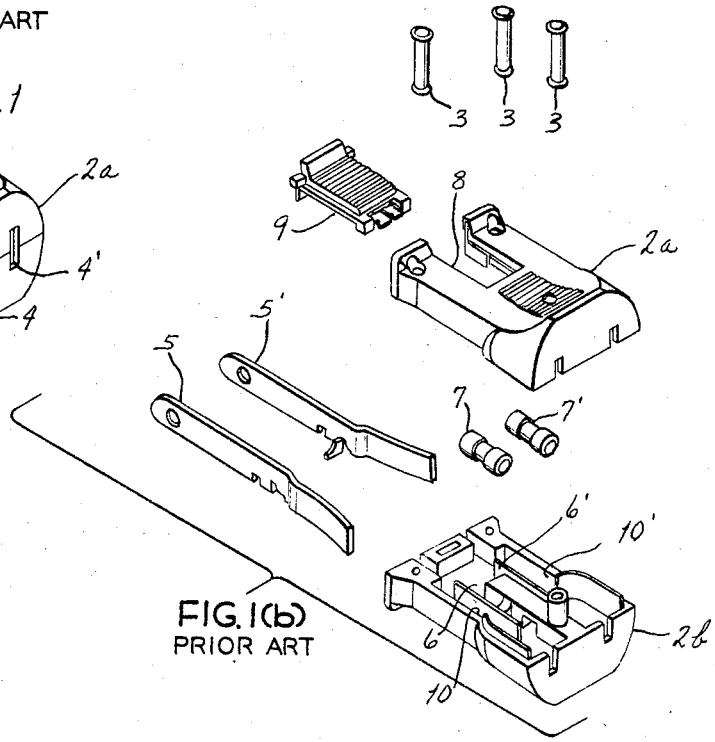
FIG. 1(b) PRIOR ART
FIG. 2
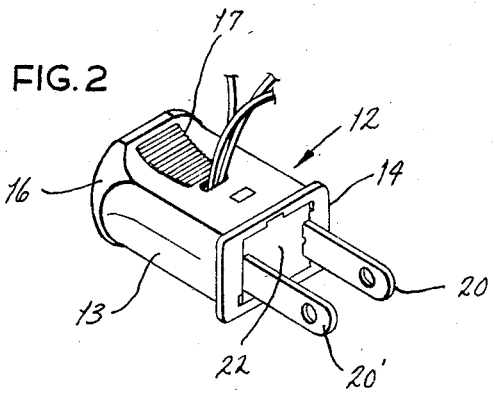
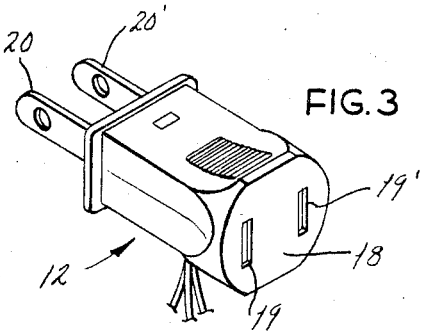
FIG. 3
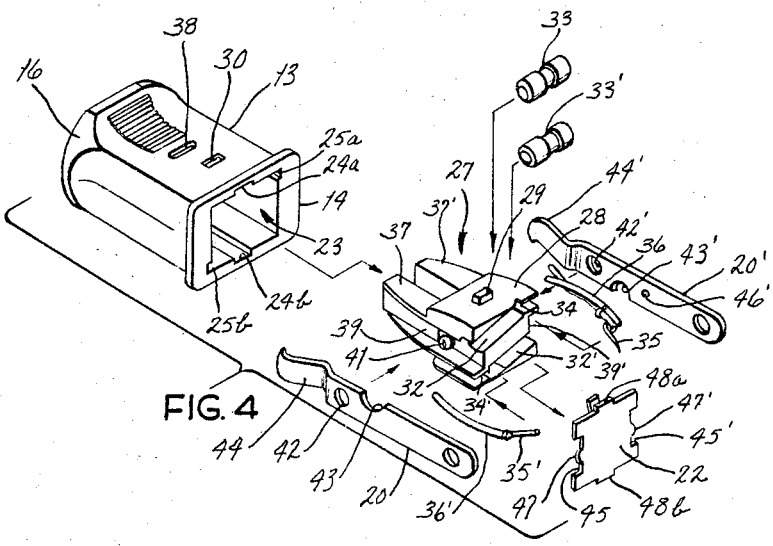
FIG. 4
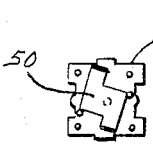
FIG. 5
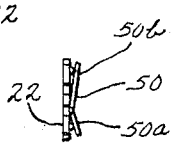
FIG. 6

REPLACEABLE FUSE ADD-ON PLUG

BACKGROUND AND SUMMARY OF THE INVENTION

The present invention relates to a fused plug and particularly to such a plug of the add-on type which permits other plugs to be plugged into such plug and thus "added on".

Light string sets of the type utilized for decorative purposes, as for holiday lighting and for Christmas trees, typically utilizing miniaturized incandescent lamps, are manufactured with relatively small guage insulated wire as befits the small operating current in the wire. Fusing is providing for the light string sets for protecting against short circuits and to provide the sets with adequate intrinsic safety (which safety will be given approval by safety rating authorities or organizations as are well-known) and to comply with various national or state or regional electrical codes.

Therefore, it has been known heretofore to utilize various conventional fuses in various ways as a part of the light string set. Among such prior art is included the concept of placing fuse lamps within the end sockets of a series circuit string. This protects the lamps between the ends of the string. Such an arrangement is disclosed in U.S. Pat. No. 4,223,248 of the present inventor, entitled "Fused Light String Set". Another arrangement provides a fused plug of the add-on type wherein the plug body which includes a pair of fuse lamps is disclosed in U.S. Pat. No. 4,350,407 of the present inventor. U.S. Pat. No. 4,030,059, also of the present inventor, discloses a fuse of the type utilizable for light string sets.

When incorporated into a plug body, fuses may either be replaceable or not. If not replaceable, the melting of the fuseable element of the fuse within the plug body means that the entire light string set must be replaced. Such construction is objectionable to persons who have economy in mind or who desire the capability of correcting the difficulty and changing the fuse.

Because of the intense competition in the marketplace, it is very important to provide a design for a fused plug which is very economical to produce. If means is incorporated for permitting the fuses within the plug body to be replaced, a complexity is added to the construction which increases the costs. The provision of moveable parts also may compromise the strength of construction. For example, Magherini U.S. Pat. No. 3,976,967 teaches a plug including a body having a fuse carrier which is pivotably moveable to a position in which cartridge fuse elements can be replaced, but the construction is relatively cumbersome and expensive to manufacture.

Such U.S. Pat. No. 3,976,967 constituted a substantial improvement over the objectionable bulky fused plug construction of Cardone U.S. Pat. No. 2,808,485 which includes a removeable cup-shaped member withdrawn to render access to relatively large, conventional cartridge fuses. The latter patent in turn represented an improvement over the fused plug constructions of McIntosh U.S. Pat. No. 2,030,016 and Gerlat U.S. Pat. No. 2,668,885 which include plug body components which could be disassembled. Holoka U.S. Pat. No. 3,833,875 may also be noted as showing a fused plug construction having a plastic case with a removeable cover. But such construction is objectionable from the viewpoints of economy and strength.

Referring to FIGS. 1(*a*) and 1(*b*), a fused add-on plug 1 of another prior art construction is shown. Said plug 1 has a plug body having an upper shell or body portion 2(*a*) and a lower shell or body portion 2(*b*) which are joined together by rivets 3, the two halves or shells defining slots or openings 4, 4' for receiving the prongs of a plug to be added on. Extending forwardly from the opposite end of the joined plug body portions are plug blades 5, 5'. The lower plug body portion 2(*b*) defines recesses 6, 6' for receiving a pair of miniature cartridge fuses 7, 7'. The upper half 2(*a*) is provided with a U-shaped recess in which is received a removable, slidable door or cover 9 which may be withdrawn for providing access to the fuses 7, 7' for inspection or replacement. However, this prior art fuse plug construction has the disadvantage of being formed of a separate rather than integral body components which, or course, must be joined together in a separate manufacturing step with rivets 3. Accordingly, the economy of manufacture is not as great as desired, and the plug further suffers from the disadvantage that it is not as strong as a plug body of integral, unitary construction.

The prior art construction of FIGS. 1(*a*) and 1(*b*) additionally exhibit a number of inherent disadvantages. For example, the plug blades 5, 5' are receivable in slots 10, 10' but nothing specifically holds them in place except the mutual fit as between the upper and lower shells or halves 2(*a*), 2(*b*). Consequently, if after use, plug 1 should develop a crack as between the upper and lower shells 2(*a*), 2(*b*), either of the plug blades 5, 5' might be permitted to shift in different directions, thus causing poor electrical contact. Another problem is that the cartridge fuses 7, 7' are pressed into place and into electrical contact by force of the sliding door or cover 9, the underside of which has a spring effect upon the fuses. However, if an add-on plug has been received numberous times by openings 4, 4', the leverage applied between the shells 2(*a*) 2(*b*) may cause a gap to open between them, reducing the spring effect on the slide or door 9. Thus, fuses 7, 7' could come loose and again result in poor electrical contact. Also, the use of rivets 3 to secure the two body shells 2(*a*) 2(*b*) is labor intensive and accordingly not economical. In addition, if the rivets are not properly riveted, a crack may result in either of the shells 2(*a*) 2(*b*), not only weakening the structure but possibly also causing poor electrical contact. A further difficulty is that the electrode or plug blade 5, 5' have a fixed, unique orientation. Hence, they cannot be interchanged. I.e., the blade on the right cannot be used on the left or vice versa. This requires production of separate elements and requires additional time and effort during assembly. Finally, the sliding door 9, if opened and closed a number of times for fuses, may ultimately become loose, and in fact, may even fall off, thereby exposing the fuses unsafely as well as causing poor electrical contact or failure.

It is an object of the present invention to provide an improved fused plug which is particularly useful with light string sets.

It is another object of the present invention to provide such an improved fused plug having construction of relative simplicity with relatively few parts which are easily produced as by injection molding to provide extreme economizing of manufacture.

An object of the present invention is also to provide such a fused plug of add-on type which is not weakened or distorted by the repeated insertion and removal of the plug blades of a plug being added on.

It is a further object of the present invention to provide such a fused plug which is of compact configuration, being neither bulky nor cumbersome in use, and having small dimensions so as not requiring the use of thick sections of material, the material of construction being thereby reduced in volume and the plug being made lightweight, but such that the plug body is of relatively great strength and provides extreme resistance to damage.

It is also an object of the present invention to provide such a fused plug which includes miniaturized fuses which are easily replaced by the common consumer without resort to special tools or without requiring expertise or finesse.

Another object of the present invention is the provision of such a fused plug which has a unitary outer shell with intrinsically high strength and resistance to damage.

A further object of the present invention is the provision of a fused plug of the type described which requires that the plug described be removed from a wall socket before fuses within the plug are accessible for replacement, thereby providing greater safety for the user.

A further object of the invention is the provision of such a fused plug which includes plug blades which are anchored to a fuse site body which is in turn anchored within the body shell so that the parts are tightly and reliably held in mutual securement so as not to be easily subjected to shaking or loosening, and so as always to provide excellent electrical contact.

Among other objects of the invention may be noted the provision of such a fused plug having high inherent safety without reliability being compromised; which is not prone to failure due to vibration, weather exposure or temperature changes or other damages; and which in general provides a high degree of safety for the consumer.

Other objects will be in part apparent and others described in the following description.

BRIEF DESCRIPTION OF THE DRAWINGS

FIG. 1(*a*) is a perspective view of a prior art fused plug of add-on type according to a prior art construction.

FIG. 1(*b*) is an exploded view of the fused plug of FIG. 1(*a*).

FIG. 2 is a perspective view of a fused plug in accordance with and embodying the present invention.

FIG. 3 is a perspective view of the new fused plug as viewed from the opposite end.

FIG. 4 is an exploded view of the fused plug of FIG. 2.

FIG. 5 is a plan view of a cover of the new fused plug, depicting its inner face.

FIG. 6 is a side elevation of the cover of FIG. 5.

DESCRIPTION OF THE PREFERRED EMBODIMENT

Referring now to FIGS. 2–6, illustrated generally at 12 is a new fused plug of the add-on type in accordance with the present invention. Plug 12 comprises a plug body or shell 13 of one piece, integral construction, such as preferrably injection molded of polymeric resin material.

Shell 13 has a forward portion forming at its outer extremity a flange 14 of generally rectangular configuration. Its rearward portion is tapered with increasing width and heighth to provide a rounded enlargement 16 of approximately elliptical character. Surfaces of the shell proximate the enlarged portion 16 are provided with areas 17 on opposite sides of the plug body having closely spaced ridges to provide a knurled effect for facilitating grip.

The outer face 18 of shell 13 is provided with a pair of openings 19, 19' for receiving the prongs of an add-on plug. Extending forwardly from the base of the plug are plug blades 20, 20' which are of conventional shape exteriorly of the plug body. As will be seen, the plug blades are identically uniquely configured interiorly of the plug to provide interchangeability as well as to promote securement within the plug.

In the assembled configuration shown in FIG. 2, plug body or shell 13 is closed, there being a fuse cover 22 which extends between the prongs or plug blades 20, 20'. The design is such that access to the interior of plug body 13 may not be had unless and until plug 12 has been withdrawn from a receptacle, thereby ensuring that one may not touch internal components of the plug unless it is so unplugged.

Referring to FIG. 4, there is seen to be defined within plug body 13 a recess 23 of generally rectangular character. Such recess 23 includes shallow upper and lower grooves 24(*a*), 24(*b*) extending longitudinally therein along the axis of elongation and centered within the internal faces of the recess. In addition, shallow grooves 25(*a*), 25(*b*) are provided along diagonally opposed corners of recess 23 for reasons which soon will be apparent.

Receivable within recess 23 is a fuse site body designated in its entirety generally at 27. Element 27 includes body portion 28 from which extend on opposite faces rectangular points or projections, as at 29, which are adapted to be received within small rectangular apertures, as at 30, opening through opposite walls of plug body 13 into the above-noted grooves 24(*a*), 24(*b*), respectively. Said main body portion 28 is dimensioned for fitting snugly between the opposed walls of body 13 which carry the apertures as designated at 30, and that is seen that such apertures and projections together serve as means for locking the fuse site body 27 in place within the plug body 13 when the plug is assembled.

Fuse site body 27 is preferrably also molded of one-piece synthetic resin material, and serves as an anchor for other internal components for the plug including, most importantly, the plug blades 20, 20', which are of brass or other strong, electrically suitable alloy.

Fuse site body 27 includes two obliquely oriented recesses 32, 32' of U-shaped section for receiving miniaturized cartridge fuses 33, 33' respectively. Recesses 32, 32' include tiny grooves 34, 34' for receiving corresponding terminals 35, 35' which are crimped to wire leads 36, 36' which are conventionally extended through an opening 38 in one face of the plug body shell 13 for connection to sockets of a light string set, for example.

The fuse site body central portion 28 includes spaced-apart longitudinal projections 37, 37' which include a relieved area or space r between them for receiving wire leads 36, 36'.

Extending longitudinally along the opposite sides of the fuse site central portion 28 are grooves 39, 39' which are rectangular cross section for receiving the plug blades 20, 20' respectively. Extending laterally outwardly into such grooves 39, 39' are short cylindrical projections, as at 41, for being received within corresponding circular apertures 42, 42' within the plug blades to the fuse site body. The fit of blades 20, 20', within slots 39, 39', is precise and close so that the plug blades similarly may not rotate or shift laterally relative to the fuse site body 27 about the projection 41 and its counterpart on the opposite side of the fuse site body.

Plug blades 20, 20' include semi-circular notches 43, 43' but such notches are oppositely oriented, one opening upwardly and the other opening downwardly but forwardly of the locking apertures 42, 42'. These notches 43, 43' are oriented for making contact with one end each of fuse 33, 33' when the latter are fitted within recesses 32, 32'. The other end of each such fuse is contacted by a respective one of terminals 35, 35'. These terminals are configured for being received within the tiny grooves 34, 34' which open into said recesses 32, 32'. Grooves 34, 34' are oriented longitudinally of the fuse site body 27 so as to lie along the respective blade plug in receiving grooves 39, 39'. Notches 34, 34' receive the wire leads 36, 36' during assembly.

Plug blades 20, 20' are formed with recurved contact portions 44, 44' which will provide electrical contact with the plug blades of a plug which is added on when the latter are received by openings 19, 19'.

Fuse cover 22 is provided with recesses 45, 45' at opposite sides for providing clearance for plug blades 20, 20', each of which is provided with a dimple or recess, as at 46', for receiving small projections 47, 47' of the fuse cover. The fuse cover also includes upper and lower projecting tabs **48*a*, 48*b* which are receivable within the longitudinal slots 24*a*, 24*b*, respectively, for tight fitment of the fuse cover, which is of course retained in place by the projections 47, 47'** into the dimples of the plug blades.

Referring to FIG. 5, fuse cover 22 is provided on its inner surface with a spring 50 which may be formed of synthetic resin material which is heat-sealed or staked to the inner face of the fuse cover and oriented to provide resilient inwardly projecting portions **50*a*, 50*b* which will bear against fuses 33, 33' when the fuse cover is in place. Thus, the fuses are pressed firmly into their recesses 32, 32'** at all times within the assembled plug.

Assembly of the plug is facilitated by construction thus provided. The wire leads 36, 36', to which the terminals 35, 35' have already been precrimped are inserted through opening 38, and the terminals are then fitted within grooves 34, 34', respectively. Either of plug blades 20, 20' is then fitted on either side of the fuse site body 27 with its aperture 42, 42' receiving the corresponding projection 41. The opposite plug blade is then similarly fitted to the fuse site body 27.

Then, the fuse site body together with the plug blades 20, 20' so fitted, and with the wire leads 36, 36' being tightened in place, are inserted within recess 23, until projection 29 and its counterpart are received within the locking aperture 30 and its counterpart, thereby locking the fuse site body as well as the plug blades within the plug body shell 13. It is then a simple matter to place cartridge fuses 33, 33' in their recesses 32, 32' and subsequently to fit cover plate 22 in place for covering the frontal opening of the plug body shell, whereupon the assembly is complete and all parts of the new plug are strongly and rigidly fixed in place with reliable electrical contact having been made.

As will be seen, the construction thus attains the advantages of the invention as well as being quite simply constructed. The integral molded plug body shell 13 withstands pressure far better than prior art two-piece constructions and does not require extrinsic fasteners such as rivets with their known defects. The assembly procedure is greatly facilitated, allowing assembly time to be reduced and thus aiding large scale manufacture with increased throughput. Furthermore, no special tools are required during assembly. Moreover, plug blades 20, 20' are rigidly anchored to fuse site body 27 which is in turn secured reliably within the plug body shell 13. Since the parts are secured and strongly maintained in place, they are not prone to shaking or loosening and provide excellent electrical contact at all times.

If a fuse should fail, it is a simple matter to remove cover 22 for replacement, and it should be apparent that plug 12 must first be completely removed from a receptacle before a fuse can be touched or replaced, thereby ensuring of user safety.

In view of the foregoing, it will be seen that the several objects of the invention and other advantages are achieved by the new constructions which has been described.

Although the foregoing includes the description of the best mode of the embodiment contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A fused plug including a body shell and a pair of plug blades extending forwardly from the body shell in spaced-apart relation, characterized by the body shell being of integral, one-piece molded construction and including a recess opening forwardly, a fuse site body slidably receivable within the recess, the fuse site body defining fuse-receiving recess means accessible through the recess opening for receiving a pair of fuses, with one end of each of the fuses in electrical contact with a respective plug blade and for providing for electrical connection of wire leads with the opposite ends of the fuses, said leads extending from the body shell, the fuse site body defining blade-receiving recesses at opposite sides for readily receiving and removing the plug blades, the plug blades each defining an aperture, the fuse site body including lateral projections within the blade-receiving recesses for being received by the apertures of the plug blades, thereby for locking the plug blades to the fuse site body in mutually secured relationship, and means for locking the fuse site body within the body shell in mutually secured relationship, and a cover separate from the fuse site body for covering the recess opening, whereby the user is prevented from having access to the fuses without first unplugging the plug blades from an electrical receptacle.

2. A fused plug according to claim 1 wherein the body shell includes a pair of plug blade openings in a rearward surface thereof for receiving plug blades of a mating plug with the mating plug blades in electrical contact with the first said plug blades.

3. A fused plug according to claim 1, the fuse-receiving recess means comprising a pair of obliquely oriented recesses, side-by-side for receiving the respective fuses.

4. A fused plug according to claim 3, the plug blades each defining recesses for receiving one end of a respective fuse, the plug blades being identically configured and interchangeable.

5. A fused plug according to claim 4, the fuse cover carrying spring means for pressing the fuses into their respective recesses.

6. A fused plug according to claim 5, the plug blades each defining an indentation proximate the recess opening, the fuse cover including projections at opposite sides for being received by the indentations for securement of the fuse cover.

7. A fused plug according to claim 6, the spring means comprising resilient projections extending inwardly of the recess from the rear surface of the fuse cover and constituted by a spring member formed of synthetic resin material secured to the rear surface of the fuse cover.

8. A fused plug according to claim 1, the means for locking the fuse site body within the body shell comprising at least one projection extending laterally from the fuse site body and a corresponding aperture defined by the body for receiving said at least one projection.

9. A fused plug according to claim 1, the fuse site body including grooves on opposite sides proximate the blade-receiving recesses, such grooves receiving and tightly maintaining the wire leads on opposite sides of the fuse site body.

10. A fused plug including a body shell and a pair of plug blades extending forwardly from the body shell in spaced-apart relation, characterized by the body shell being of integral, one-piece molded construction and including a recess opening forwardly, the body shell including a pair of plug blade openings in a rearward surface thereof for receiving plug blades of a mating plug with the mating plug blades in electrical contact with the first said plug blades, a fuse site body receiveable within the recess, the fuse site body defining a pair of obliquely oriented side-by-side fuse-receiving recesses accessible through the recess opening for respectively receiving a pair of fuses, with one end of each of the fuses in electrical contact with a respective plug blade and for providing for electrical connection of wire leads with the opposite ends of the fuses, said leads extending from the body shell, the fuse site body defining blade-receiving recesses at opposite sides for readily receiving and removing the plug blades, the plug blades each defining an aperture, the fuse site body including lateral projections within the blade-receiving recesses for being received by the apertures by the plug blades, thereby for locking the plug blades to the fuse site body in mutually secured relationship, and means for locking the fuse site body within the body shell in mutually secured relationship, and a fuse cover separate from the fuse site body for covering the recess opening, the fuse cover carrying a spring member secured to a rear surface of the fuse cover and having a pair of resilient projections each obliquely oriented and extending inwardly of said obliquely oriented recesses for bearing against the respective fuses in said obliquely oriented recesses, the user being prevented from having access to the fuses without first unplugging the plug blades from an electrical receptacle.

* * * * *